United States Patent [19]

Pafford et al.

[11] Patent Number: 4,566,966

[45] Date of Patent: Jan. 28, 1986

[54] OCTANE CATALYTIC CRACKING PROCESS

[75] Inventors: Bernie J. Pafford; Carl F. Bertsch, both of Baton Rouge, La.

[73] Assignee: Exxon Research and Engineering Co., Florham Park, N.J.

[21] Appl. No.: 624,939

[22] Filed: Aug. 28, 1984

Related U.S. Application Data

[63] Continuation of Ser. No. 510,076, Jun. 30, 1983, abandoned.

[51] Int. Cl.[4] ..... C10G 11/00

[52] U.S. Cl. ..... 208/113; 208/120; 502/50

[58] Field of Search ..... 208/DIG. 1, 52 CT, 113, 208/120

[56] References Cited

U.S. PATENT DOCUMENTS

| | | | |
|---|---|---|---|
| 3,718,553 | 2/1973 | Stover | 208/120 |
| 4,148,714 | 4/1979 | Nielsen et al. | 208/114 |
| 4,162,213 | 7/1979 | Zrinscak, Sr. et al. | 208/89 |
| 4,200,520 | 4/1980 | Gladrow et al. | 208/120 |
| 4,244,810 | 1/1981 | Youngblood et al. | 208/120 |
| 4,268,416 | 5/1981 | Stine et al. | 252/416 |
| 4,280,895 | 7/1981 | Stuntz et al. | 208/113 |
| 4,280,896 | 7/1981 | Bearden, Jr. et al. | 208/113 |
| 4,298,459 | 11/1981 | Tatterson et al. | 208/120 |
| 4,361,496 | 11/1982 | Castillo et al. | 252/416 |
| 4,364,848 | 12/1982 | Castillo et al. | 252/417 |

FOREIGN PATENT DOCUMENTS 0052356 5/1982 European Pat. Off. .

*Primary Examiner*—D. E. Gantz
*Assistant Examiner*—O. Chaudhuri
*Attorney, Agent, or Firm*—Edward H. Mazer

[57] ABSTRACT

A method for improving the octane rating of products from a catalytic cracking system is disclosed. The method is directed at maintaining the metal contaminant level on the cracking catalyst above about 400 wppm equivalent metal and periodically passing the cracking catalyst through a passivation zone having a reducing atmosphere maintained at an elevated temperature to passivate the metal contaminant on the cracking catalyst.

18 Claims, 4 Drawing Figures

OCTANE CATALYTIC CRACKING PROCESS

This is a continuation of application Ser. No. 510,076, filed June 30, 1983, now abandoned.

BACKGROUND OF THE INVENTION

The present invention is directed at a process for catalytic cracking of hydrocarbon feedstocks. More specifically, the present invention is directed at a method for improving the octane number of feedstocks processed by catalytic cracking.

In the catalytic cracking of hydrocarbon feedstocks the feedstock is cracked into lower molecular weight products. One of the most important factors in determining catalytic cracking conditions is the octane number of the cracked product. One method of improving the octane number of the cracked product has been to use relatively expensive, specially formulated high octane cracking catalysts. However, the use of these catalysts is not advantageous in many instances, particularly where the feedstocks contain significant concentrations of metals, such as nickel, vanadium and/or iron. These metal contaminants become deposited on the cracking catalyst promoting excessive hydrogen and coke makes. Producing a high octane cracked product often has necessitated the frequent regeneration and/or replacement of the cracking catalyst.

Previously, it has been noted that the presence of metal contaminants, such as nickel, iron, and vanadium, on cracking catalyst may operate to improve the octane number of the cracked product. U.S. Pat. No. 4,200,520 describes a method for improving the octane number of cracked product by maintaining the metals content on the catalyst within the range of about 1,500 to 6,000 parts per million by weight (wppm), preferably from about 2,500 to about 4,000 wppm of equivalent nickel. The desired metals level is achieved by adding a metals-containing heavy feedstock intermittently or continuously with the gas oil. This patent also suggests maintaining the metals level within the predetermined limits by withdrawing high metals-containing catalyst from the system and adding low metals-containing catalyst to the cracking zone. However, adding metal-containing feeds may result in a large number of active metal sites which contribute to excess hydrogen and coke production. U.S. Pat. No. 3,718,553 also discloses that the octane number of a cracked feedstock may be improved by regulating the metals content on the feed. This patent discloses controlling the amount of nickel, iron, and/or vanadium on the catalyst within the range of about 100 to about 1,000 wppm by preimpregnating the catalyst within the desired amount and type of metal.

However, it also has been found that the presence on cracking catalyst of metal contaminants, such as nickel, vanadium, and iron, may lead to excessive hydrogen and coke makes. Several patents have been issued which disclose methods for reducing the detrimental effects of metal contaminants on cracking catalyst. U.S. Pat. Nos. 4,280,895 and 4,280,896 disclose that cracking catalyst can be passivated by passing the catalyst through a reducing zone having a reducing atmosphere therein maintained at an elevated temperature for a period of time ranging from about 30 seconds to 30 minutes. These patents also disclose that selected metal contaminants may be added to the cracking system to improve the degree of passivation. U.S. Pat. No. 4,298,459 describes a process for cracking a metals containing feedstock where the cracking catalyst is subjected to alternate exposures of up to 30 minutes in an oxidizing zone and in a reducing zone maintained at an elevated temperature to thereby reduce the hydrogen and coke makes. U.S. Pat. Nos. 4,268,416; 4,361,496; 4,364,848; and 4,382,015; European Patent Publication No. 52,356; and PCT Patent Publication No. WO/04063 all describe methods for passivating cracking catalyst in which metal contaminated cracking catalyst is contacted with a reducing gas at elevated temperatures to passivate the catalyst. However, these publications do not disclose a method for increasing the octane rating of the cracked product.

It is desirable to provide a process which would permit the production of a cracked product having a relatively high octane number without the production of excessive hydrogen and coke.

It also is desirable to provide a process in which a high octane cracked product is produced without the use of significant quantities of relatively expensive cracking catalyst.

It also is desirable to provide a process in which equilibrium catalyst which had been removed from cracking units may be reused.

The subject invention is directed at a process for improving the octane number of cracked product by maintaining the metals content at a predetermined level and by passing the catalyst which has been regenerated from the regeneration zone through a passivation zone prior to its return to the cracking zone.

SUMMARY OF THE INVENTION

The present invention is directed at a method for cracking a hydrocarbon feedstock to lower molecular weight products in a cracking system comprising a reaction zone, a regeneration zone, and a passivation zone wherein:

(a) feedstock containing metal contaminant is passed into the reaction zone having cracking catalyst therein wherein the feedstock is cracked to lower molecular weight products and coke, coke and metal contaminant becoming deposited on the catalyst;

(b) coke and metal contaminated catalyst is passed from the reaction zone to a regeneration zone wherein coke is removed from the catalyst to regenerate the catalyst; and, (c) regenerated catalyst from the regeneration zone is passed through a passivation zone prior to return to the reaction zone, the improvement comprising (i) monitoring the octane level of the cracked product; and, (ii) adjusting the metal contaminant level on the catalyst to maintain the octane level within predetermined limits.

The present invention also is directed at:

(i) monitoring the production of hydrogen and/or coke in the reaction zone; and (ii) adjusting the metal contaminant level on the catalyst to maintain the hydrogen and/or coke production in the reaction zone within predetermined limits.

The present invention also may be practiced by:

(i) monitoring the metal contaminant level on the cracking catalyst; and (ii) adjusting the metal contaminant level on the cracking catalyst to maintain the metal contaminant level on the catalyst within predetermined limits.

The metal contaminant may be nickel, vanadium or mixtures thereof. The metal contaminant level on the cracking catalyst preferably is maintained at a level greater than about 400 wppm equivalent nickel, more preferably in the range of about 600 wppm to about 2300 wppm equivalent nickel and most preferably in the range of about 700 wppm to about 2300 wppm equivalent nickel.

The octane level of the cracked product is a function of many variables, including the feedstock utilized, the catalyst employed, and the processing conditions in the reaction zone. Typically, the cracked product will have a Research Octane Number, Clear (RONC) ranging between about 85 and about 95.

The hydrogen and coke production in the reaction zone will be a function of the feedstock utilized, the catalyst employed, and the processing conditions in the reaction zone. The amount of hydrogen and/or coke production which can be tolerated will be dependent on the design of each cracking system.

When a vacuum gas oil is utilized as the feed to the cracking system, the hydrogen production normally is maintained below about 200 SCF/Barrel of metered feed (fresh feed+recycle), preferably below about 150 SCF/Barrel, and more preferably in the range of about 25-75 SCF/Barrel.

In one method of practicing the subject invention, metal contaminated cracking catalyst is added to the cracking system to maintain the metal contaminant level on the cracking catalyst within the predetermined range. The metal contaminated catalyst preferably comprises from about 5 to about 100 wt% of the total replacement catalyst added to the cracking system. This method is of particular utility in producing a relatively high octane product from a feedstock having a relatively low metal contaminant content, such as a vacuum gas oil.

DETAILED DESCRIPTION OF THE INVENTION

Figure 1:
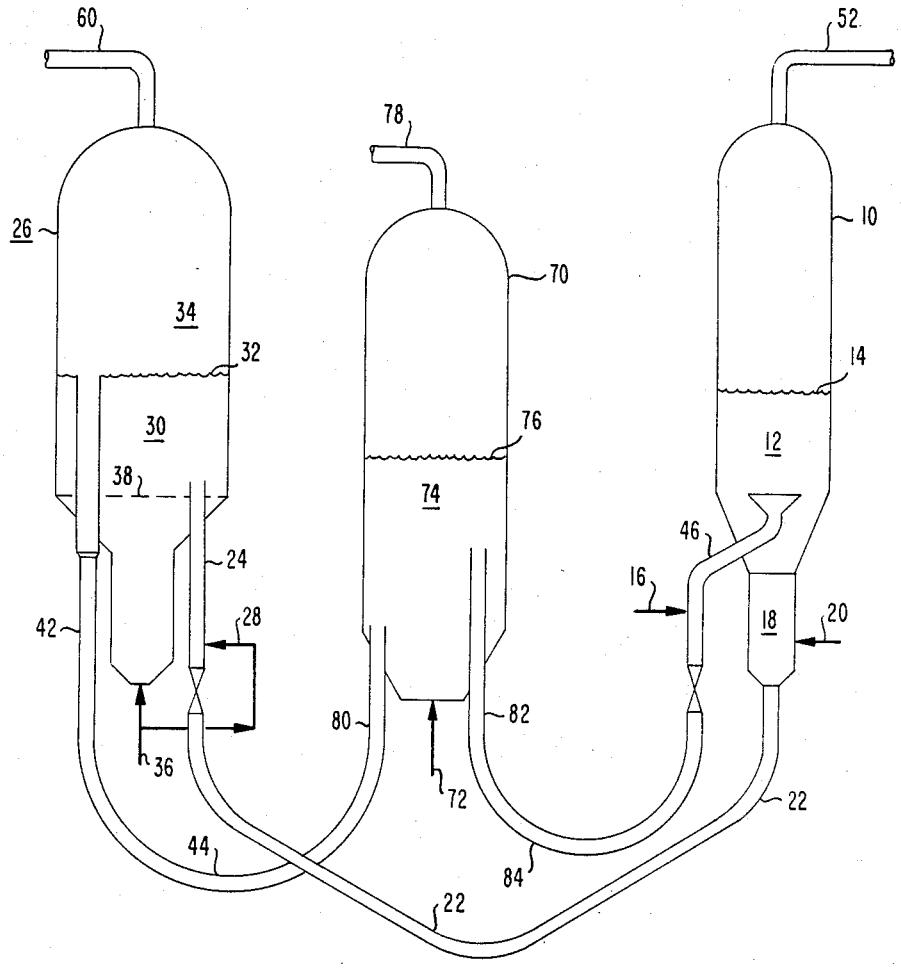
FIG. 1 is a simplified schematic drawing showing one method of practicing the subject invention.

Referring to FIG. 1, a simplified schematic drawing of a cracking system is shown. In this figure all pumps, valves, instrumentation, and related equipment not necessary for an understanding of the present invention have been eliminated for clarity. Reaction or cracking zone 10 is shown containing a fluidized catalyst bed 12 having a level at 14 in which a hydrocarbon feedstock is introduced into the fluidized bed through line 16 for catalytic cracking. The hydrocarbon feedstock may comprise naphthas, light gas oils, heavy gas oils, residual fractions, reduced crude oils, cycle oils derived from any of these, as well as suitable fractions derived from shale oil, kerogen, tar sands, bitumen processing, synthetic oils, coal hydrogenation and the like. Heavy feedstocks such as deasphalted oils, high end-point gas oils, atmospheric and/or vacuum residua, typically contain relatively high concentrations of vanadium and/or nickel i.e. from about 2 to about 1600 wppm of metals on 650° F.+ feed to the reaction zone, whereas light feedstocks, such as heavy naphtha, light cycle oil, paraffinic gas oils, hydrotreated naphthas and light cycle oils, typically contain reduced amounts of vanadium and/or nickel i.e. from about 0.001 to about 1.0 wppm of metals.

Hydrocarbon gas and/or vapors passing through fluidized bed 12 maintain the bed in a dense turbulent fluidized condition. The cracked vaporized products exit zone 10 through line 52. In reaction zone 10 the cracking catalyst typically becomes spent during contact with the hydrocarbon feedstock due to the deposition of coke thereon. As used herein, the terms "spent" or "coke contaminated" catalyst refers to catalyst which has passed through a reaction zone and which contains a sufficient quantity of coke thereon to cause activity loss, thereby requiring regeneration. Generally the coke content of spent catalyst will vary from about 0.5 to about 5 wt.% or more.

Prior to actual regeneration, the spent catalyst may be passed from reaction zone 10 through a stripping zone 18 where it is contacted with a stripping gas introduced into zone 18 via line 20. The stripping gas, such as steam, serves to remove most of the volatile hydrocarbons remaining on the catalyst. The stripping zone typically is maintained at essentially the same temperature as the reaction zone, i.e., from about 450° C. to about 600° C. Stripped, spent catalyst from which most of the volatile hydrocarbons have been removed then passes from the bottom of stripping zone 18 through U-bend 22 into a connecting vertical riser 24 which extends into the lower portion of regeneration zone 26. Air introduced into riser 24 via line 28 reduces the density of the catalyst flowing therein, thereby causing the catalyst to flow upward into regeneration zone 26 by a simple hydraulic balance. Regeneration zone 26 is shown having a dense phase catalyst bed 30 with the level indicated at 32 which is undergoing regeneration to burn off coke deposits formed in the reaction zone during the cracking process. Above dense phase bed 30 is a dilute phase 34. Oxygen containing regeneration gas enters the lower portion of regeneration zone 26 via line 36 and passes up through a grid 38 and dense bed 30 maintaining the bed in a turbulent, fluidized condition similar to that present in reaction zone 10. The flue gas from regeneration zone 26 exits regeneration zone 26 through line 60. The design and operating conditions of reaction zone 10 and regeneration zone 26 are not critical and are well known by those skilled in the art. The regenerated catalyst from regeneration zone 26 is shown flowing downwardly through standpipe 42, U-bend 44 and line 80 into passivation or reduction zone 70 maintained at a temperature above 500° C., preferably above 600° C., having a reducing agent such as hydrogen, carbon monoxide, light hydrocarbons, such as $C_1$–$C_3$ hydrocarbons, or mixtures thereof, entering through line 72 to maintain a reducing environment in the passivation zone to thereby passivate the metal contaminants. As described more fully hereinafter, and as described in U.S. Pat. No. 4,280,895, the disclosure of which is incorporated herein by reference, reduction or passivation zone 70 may be any vessel providing suitable contact of the catalyst with a reducing environment at elevated temperatures. The shape of passivation zone 70 is not critical. In the embodiment shown, passivation zone 70 has a shape similar to that of regeneration zone 26 with the reducing environment maintained, and catalyst fluidized by, reducing agent entering through line 72 and exiting through line 78. The residence time of the catalyst in passivation zone 70 is not critical provided that the catalyst is sufficiently passivated. Passivated catalyst from passivation zone 70 passes through return line 82 and U-bend 84 to reaction zone 10. The residence time in passivation zone 70 may range from about 5 seconds to about 30 minutes. The pressure in passivation zone 70 is not critical and generally will be a function of the location of the passivation zone in the system and the pressure in the adjacent regeneration and reaction zones. The temperature in passivation zone 70 should be above about 500° C., preferably above about 600° C., but below the temperature at which the catalyst sinters or degrades. A preferred temperature range is about 600° C. to about 850° C., with a more preferred temperature range being about 650° C. to about 750° C. Passivation zone 70 preferably is disposed after the regeneration zone so that the heat imparted to the catalyst by the regeneration obviates or minimizes the need for additional catalyst heating in the passivation zone. Passivation zone 70 can be constructed of any chemically resistant material able to withstand the relatively high temperatures and the attrition conditions which are inherent in fluidized catalyst systems. The specific reducing agent used in passivation zone 70 is not critical. It is expected that typically the reducing agent utilized will be one which is readily available. Examples of suitable reducing agents are cat cracker tail gas, catalytic reformer off-gas, spent hydrogen streams from catalytic hydroprocessing, synthesis gas, and flue gases. The rate of consumption of the reducing agent in passivation zone 70 will be dependent upon the amount of reducible material entering the passivation zone. In a typical fluidized cracking system it is anticipated that about 10 to about 100 scf of hydrogen would be required for each ton of catalyst passed through passivation zone 70. As indicated in the following examples, maintaining the metals content on the cracking catalyst above about 400 wppm preferably within the range of about 600 to about 2300 wppm equivalent nickel, results in a cracked product having an improved octane rating without the production of excessive amounts of hydrogen and coke and without a significant decrease in the rate of conversion. As used herein the term "equivalent nickel" is defined to be $$Ni + V/4$$

A series of tests were conducted to compare the naphtha yield, octane, hydrogen make, and coke make using low and high metals content equilibrium cracking catalyst. As used herein the term "equilibrium catalyst" is defined to be cracking catalyst which has been removed from a cracking system operated at steady-state condition.

The equilibrium cracking catalyst utilized was Super DX catalyst, a silica-alumina zeolite cracking catalyst manufactured by Davison Chemical Company, a division of W. B. Grace & Co.

The low metals content equilibrium catalyst comprised 185 wppm nickel and 220 wppm vanadium which produced a catalyst having about 240 wppm equivalent nickel. The high metals content equilibrium catalyst was prepared by impregnating the low metals equilibrium catalyst with an additional 1000 wppm nickel and 4000 wppm vanadium to produce a catalyst having about 2240 wppm equivalent nickel. Both catalysts were used without any passivation treatment, with four pounds of catalyst being circulated through the reaction zone for each pound of feed introduced. The product composition was determined by fluorescent indicator adsorption as described in ASTM procedure D-1319, the disclosure of which is incorporated herein by reference. It can be seen from Table 1 that the research octane number, clear (RONC) increased by 4.3 and the motor octane number, clear (MONC) increased by 2.8 when the high metals content equilibrium catalyst was used as compared to the octane numbers using the low metals equilibrium catalyst. However, it also should be noted that the coke make more than doubled and the hydrogen production increased almost tenfold for the high metals content catalyst due to the presence of the metals.

EXAMPLE 1

This Example indicates that the high metal contaminant content catalyst produced a cracked product having improved research and motor octane numbers while not producing excessive amounts of coke and hydrogen when the catalyst was passed through a passivation zone for a residence time of 20 minutes or 7 hours prior to use. This data also is presented in Table 1.

TABLE 1

CRACKED PRODUCT CHARACTERISTICS

| | LOW METALS EQUILIBRIUM SUPER DX | HIGH METALS CONTENT EQUILIBRIUM SUPER DX | | |
|---|---|---|---|---|
| | | | $H_2$ TREATED | |
| | | OXIDIZED | 20 MIN. | 7 HRS |
| Metals Content Eq. Ni, wppm | 240 | 2,240 | 2,240 | 2,240 |
| Conversion, LV % | 68.2 | 64.6 | 64.7 | 69.4 |
| Naphtha | | | | |
| Yield | 58.5 | 49.6 | 49.7 | 55.1 |
| Selectivity | 85.8 | 76.5 | 76.8 | 79.4 |
| RONC | 88.5 | 92.8 | 93.5 | 92.7 |
| MONC | 78.7 | 81.5 | 81.0 | 81.5 |
| Naphtha Composition | | | | |
| Saturates | 31.2 | 32.2 | 36.2 | 40.9 |
| Olefins | 44.2 | 37.6 | 28.6 | 28.7 |
| Aromatics | 24.6 | 30.2 | 35.2 | 30.4 |
| Coke, Wt. % | 3.0 | 6.9 | 4.0 | 3.6 |
| Hydrogen, wt. % | 0.08 | 0.77 | 0.28 | 0.24 |

It may be seen from Table 1 that the exposure of the high metal contaminated catalyst in passivation zone 70 reduced the coke and hydrogen makes to levels substantially similar to that produced with the low metal contaminated catalyst. Surprisingly, however, it should be noted that the research and motor octane numbers were substantially the same as that produced with the high metals contaminated catalyst which was not exposed to passivation zone 70 despite the differences in the naphtha composition caused by the reduction treatment. Thus, it may be seen that zone 70 passivates the catalyst while not significantly decreasing the ability of the metal contaminated catalyst to produce cracked product having improved research and motor octane numbers.

Additional tests were conducted using Super DX cracking catalyst having 400, 600, 700, 800, 1100 and 1450 wppm equivalent nickel to determine the preferred range of metals level on cracking catalyst. The equivalent nickel level in the cracking catalyst inventory was increased from 400 wppm to 1450 wppm by incrementally adding equilibrium catalyst that had been impregnated with an additional 1000 wppm nickel and 4000 wppm vanadium. At each metals level, research and motor octane levels, hydrogen and coke yields were determined for unpassivated catalyst utilized in a reaction zone maintained at 950° F. and 15 p.s.i.g. with four pounds of catalyst circulated for each pound of feedstock introduced. The results are plotted in FIGS. 2, 3 and 4.

EXAMPLE 2

In this example, the various catalyst samples impregnated with 400–1450 wppm of equivalent nickel were passivated by exposure to a hydrogen atmosphere at 1300° F. for two hours. The catalyst subsequently was utilized in a reaction zone maintained at 950° F. and 15 p.s.i.g. with four pounds of catalyst circulated for each pound of feedstock introduced. The research and motor octane values are plotted in FIG. 2, while the hydrogen and coke yields are plotted in FIGS. 3 and 4, respectively, all as a function of the metal contaminant level on the catalyst.

Figure 2:
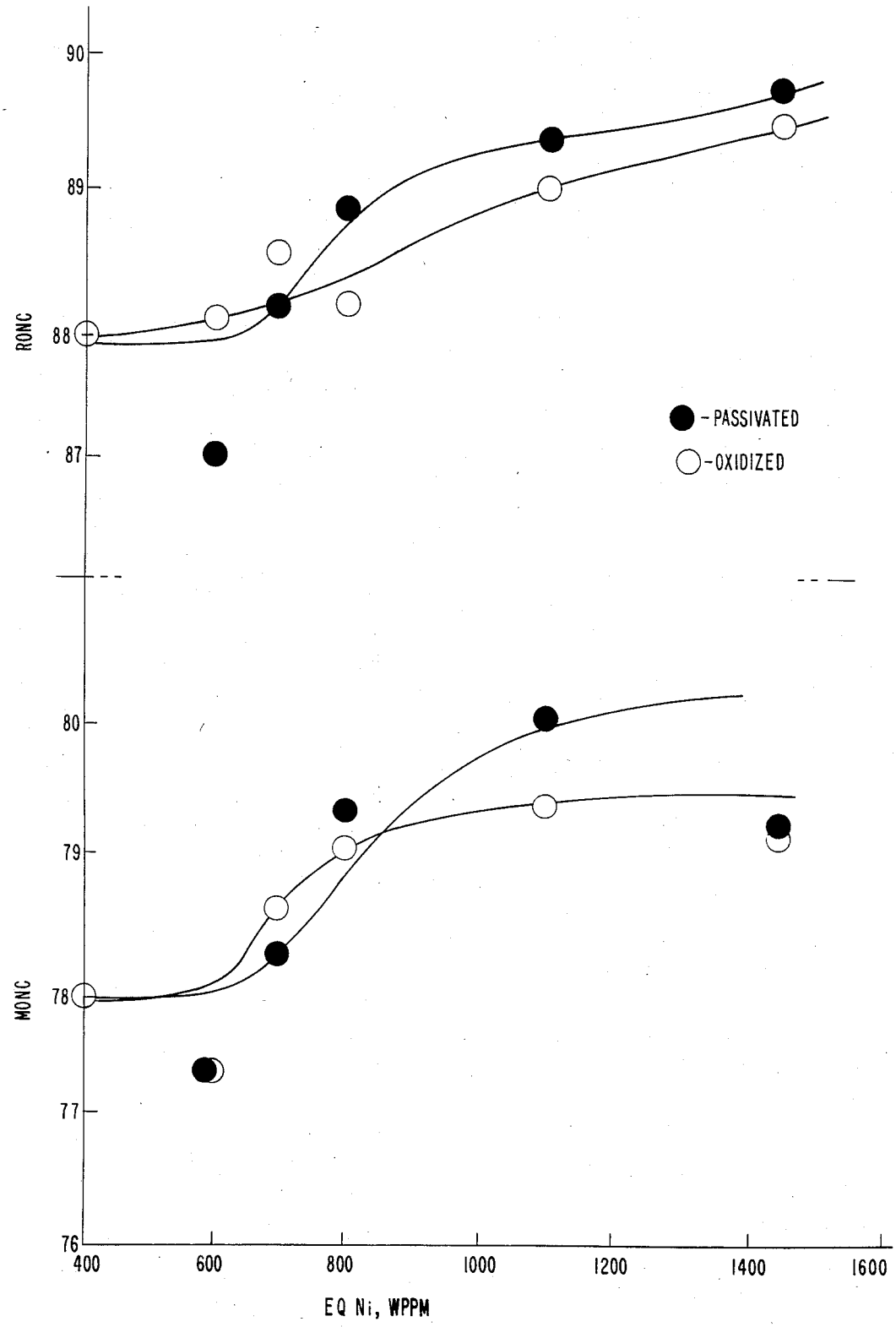
FIG. 2 is a plot of clear research and motor octanes for both passivated and unpassivated cracking catalyst as a function of equivalent nickel contaminant level on the catalyst.
Figure 3:
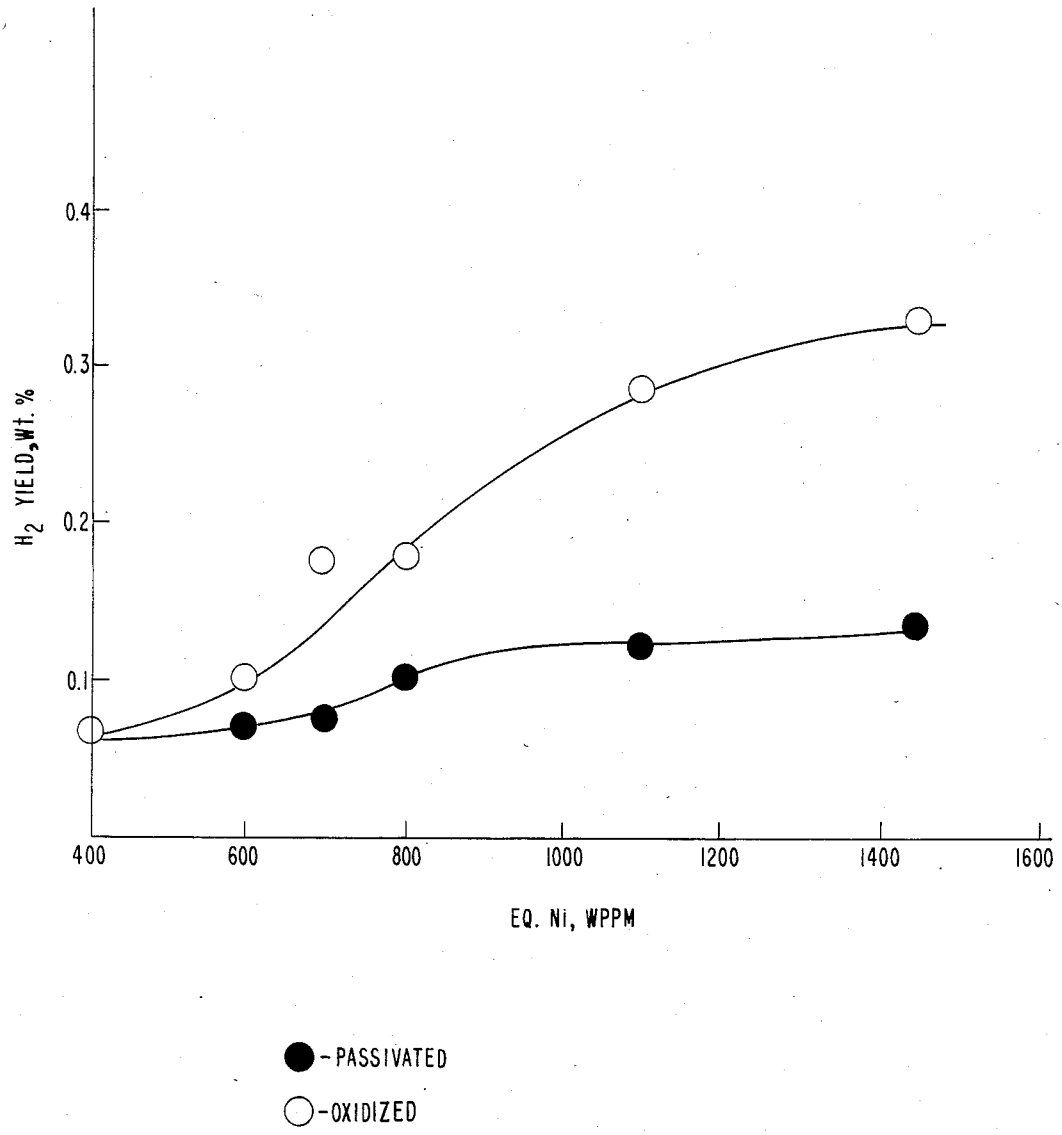
FIG. 3 is a plot of the hydrogen yield for both passivated and unpassivated cracking catalyst as a function of equivalent nickel contaminant level on the catalyst.
Figure 4:
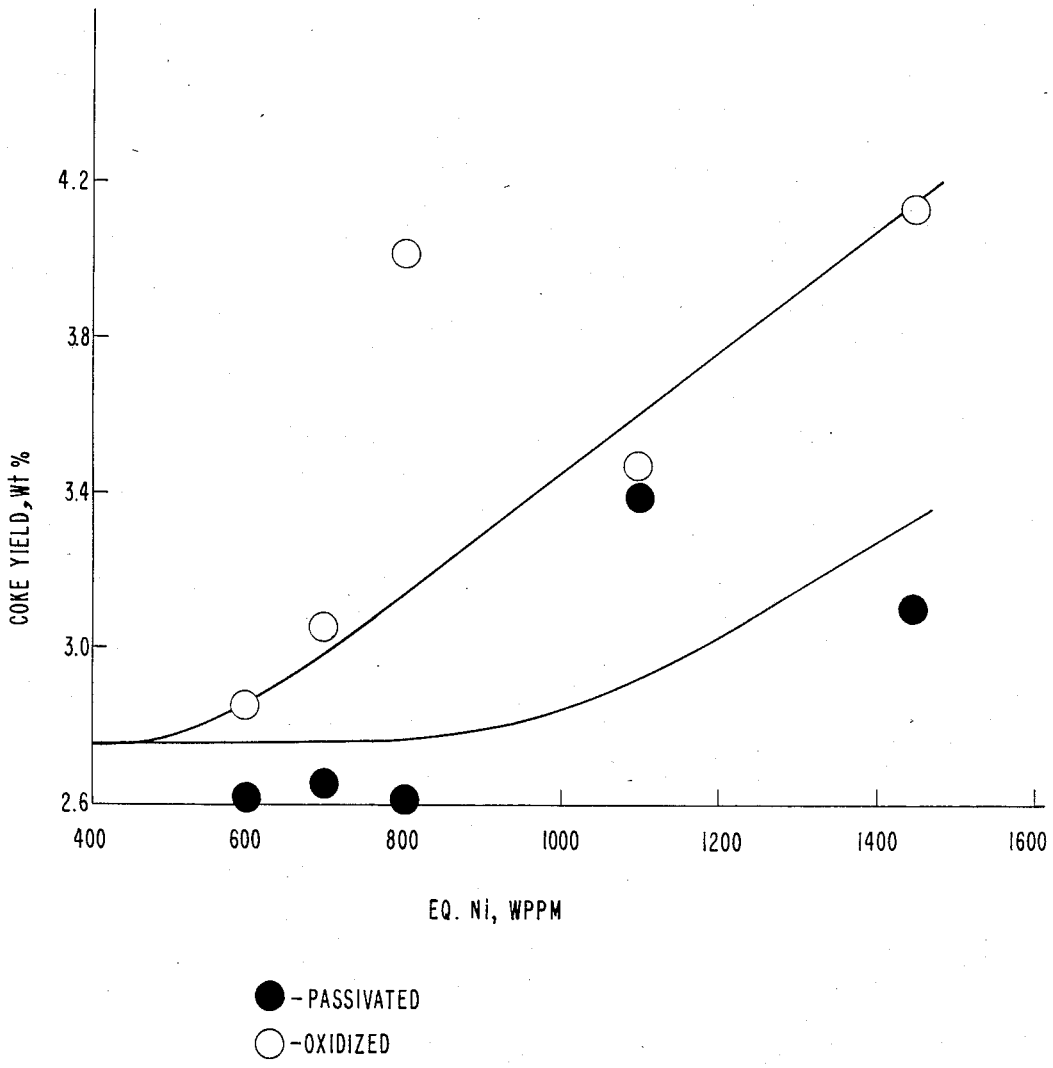
FIG. 4 is a plot of the coke yield for both passivated and unpassivated cracking catalyst as a function of equivalent nickel contaminant level on the catalyst.

FIG. 2 indicates that as the metal contaminant level on the catalyst increases, particularly, above 700 wppm equivalent nickel, both the research and motor octane numbers increase. This figure also shows that the passivated catalyst sample demonstrated generally higher octanes at comparable metals loadings to the unpassivated catalyst samples. FIGS. 3 and 4 demonstrate that, as the metal level on the catalyst increases, the hydrogen and coke yields increase for both the passivated and unpassivated catalyst samples. However, the passivated catalyst samples show a much smaller increase in hydrogen and coke yields than the unpassivated samples. In particular, it should be noted that, for the passivated catalyst samples, the hydrogen yield did not show a substantial increase until a metal contaminant level greater than 700 wppm equivalent nickel was reached. Similarly, the coke yield did not demonstrate a significant increase until after 800 wppm equivalent nickel had been added to the catalyst.

Thus, the claimed process can be utilized to produce cracked product having improved octane values without excessive hydrogen and coke production. This is demonstrated by the data summarized in Table 2, where the octane, hydrogen and coke makes for catalyst having varying metals levels are summarized.

TABLE 2

| Parameter | Unpassivated | $H_2$ Passivated 2 hrs. at 1300° F. | |
|---|---|---|---|
| Metals Loading; Eq. Ni, wppm | 400 | 800 | 1450 |
| RONC | 87.9 | 88.7 | 89.6 |
| MONC | 77.9 | 79.2 | 79.5 |
| $H_2$ wt. % | 0.065 | 0.099 | 0.125 |
| Coke wt. % | 2.75 | 2.6 | 3.2 |

From the data of Table 2 it can be seen that the 800 wppm eq. Ni catalyst produced a cracked product having increased RONC and MONC values of 0.8 and 1.3, respectively, as compared to the unpassivated catalyst with no increase in coke yield and only a small increase in hydrogen yield. At 1450 wppm equivalent nickel, increases of 1.7 and 1.6, were obtained in the RONC and MONC values, respectively, as compared to the unpassivated catalyst. The increases in hydrogen and coke of 0.06 wt.% and 0.4 wt.%, respectively, would not be considered detrimental in view of the significant octane improvements realized.

Where the feed has a relatively low metal content, such as a vacuum gas oil distillate, one method for maintaining an elevated catalyst metals level is by the use of a metals contaminated equilibrium catalyst from another cracking zone. The addition of such an equilibrium catalyst thus would serve a twofold purpose. Increasing the catalyst metals level, improves the research and motor octane numbers of the cracked product, while reusing equilibrium catalyst decreases the cost of the replacement catalyst added to the system. In such a system the rate at which equilibrium catalyst is added would be dependent upon several factors including: the desired metal content on the catalyst in the cracking system, the metals content on the equilibrium catalyst to be added, and the required replacement rate of catalysts due to attrition and other losses, and the metals content of the entering feedstock. Where a feedstock having a relatively high metals content, such as high endpoint gas oils, deasphalted oils, and atmospheric and/or vacuum residua are used, the metals content on the catalyst may be maintained at a relatively high level by reducing the catalyst replacement rate to the cracking system and/or by also adding amounts of metal contaminated equilibrium catalyst to the system. The metal contaminated catalyst preferably will comprise from about 5 to about 100 wt% of the total replacement catalyst added to the system.

While the subject process has been described with respect to a specific embodiment it will be understood that it is capable of further modification. Any variations, uses or adaptations of the invention following in general the principles of the invention are to be covered, including such departures from the present disclosure as come within known or customary practice in the area to which the invention pertains and as may be applied to the essential features hereinbefore set forth and as fall within the scope of the invention.

What is claimed is:

1. In a method for cracking a hydrocarbon feedstock to lower molecular weight products in a cracking system comprising a reaction zone, a regeneration zone, and a passivation zone wherein:

(a) feedstock containing metal contaminant is passed to the reaction zone having cracking catalyst therein wherein the feedstock is cracked to lower molecular weight products and coke, coke and metal contaminant becoming deposited on the catalyst;

(b) coke and metal contaminated catalyst is passed from the reaction zone to a regeneration zone wherein coke is removed from the catalyst to regenerate the catalyst; and, (c) regenerated catalyst from the regeneration zone is passed through a passivation zone prior to return to the reaction zone, the improvement comprising:

(i) monitoring the octane level of the cracked product; and (ii) adjusting the metal contaminant level on the catalyst to maintain the octane level within a predetermined range by the addition to the cracking system of metal contaminated equilibrium cracking catalyst possessing a higher equivalent nickel content than the cracking catalyst in the reaction zone.

2. The method of claim 1 wherein the metal contaminant is selected from the group consisting of nickel, vanadium and mixtures thereof.

3. The method of claim 2 wherein the metal contaminant level in the cracking catalyst is maintained within the range of about 400 to about 2300 wppm equivalent nickel.

4. The method of claim 3 wherein the metal contaminant level on the cracking catalyst is maintained within the range of about 600 to about 2300 wppm equivalent nickel.

5. The method of claim 2 wherein the equilibrium cracking catalyst added to the cracking system comprises from about 5 to about 100 wt.% of the total replacement catalyst added to the cracking system.

6. The method of claim 2 wherein the Research Octane Number, Clear is maintained within the range of about 85 to about 95.

7. In a method for cracking a hydrocarbon feedstock to lower molecular weight products in a cracking system comprising a reaction zone, a regeneration zone, and a passivation zone wherein:

(a) feedstock containing metal contaminant is passed to the reaction zone wherein the feedstock is cracked to lower molecular weight products and coke, coke and metal contaminant becoming deposited on the catalyst;

(b) coke and metal contaminated catalyst is passed from the reaction zone to a regeneration zone wherein coke is removed from the catalyst to regenerate the catalyst; and (c) regenerated catalyst from the regeneration zone is passed through a passivation zone prior to return to the reaction zone; the improvement comprising:

(i) monitoring the hydrogen and/or coke production in the reaction zone;

(ii) monitoring the octane level of the cracked product; and (iii) adjusting the metal contaminant level on the catalyst to maintain the hydrogen and/or coke production being monitored in step (i) above and the octane level being monitored in step (ii) above within predetermined ranges by regulating the addition to the cracking system of metal contaminated equilibrium cracking catalyst possessing a higher equivalent nickel content than the cracking catalyst in the cracking zone.

8. The method of claim 7 wherein the metal contaminant is selected from the group consisting of nickel, vanadium and mixtures thereof.

9. The method of claim 8 wherein the hydrogen production is maintained below about 200 SCF/Barrel of metered feed.

10. The method of claim 9 wherein the hydrogen production is maintained below about 150 SCF/Barrel of metered feed.

11. The method of claim 10 wherein the hydrogen production is maintained below about 25–75 SCF/Barrel of metered feed.

12. The method of claim 8 wherein the equilibrium cracking catalyst added to the system comprises from about 5 to about 100 wt.% of the total cracking catalyst added to the system.

13. The method of claim 12 wherein the metal contaminant level on the cracking catalyst is maintained above about 400 wppm equivalent nickel.

14. The method of claim 13 wherein the metal contaminant level on the catalyst is maintained within the range of about 600 to about 2300 wppm equivalent nickel.

15. In a method for cracking a hydrocarbon feedstock to lower molecular weight products in a cracking system comprising a reaction zone, a regeneration zone, and a passivation zone wherein:

(a) feedstock containing metal contaminant is passed to the reaction zone having cracking catalyst therein wherein the feedstock is cracked to lower molecular weight products and coke, coke and metal contaminant becoming deposited on the catalyst;

(b) coke and metal contaminated catalyst is passed from the reaction zone to a regeneration zone wherein coke is removed from the catalyst to regenerate the catalyst; and (c) regenerated catalyst from the regeneration zone is passed through a passivation zone prior to return to the reaction zone, the improvement comprising (i) monitoring the octane level of the cracked product; and (ii) adjusting the metal contaminant level on the catalyst within a predetermined range above about 400 wppm equivalent nickel by the addition to the cracking system of a metal contaminated equilibrium cracking catalyst possessing a higher equivalent nickel content than the cracking catalyst in the reaction zone.

16. The method of claim 15 wherein the metal contaminant is selected from the group consisting of nickel, vanadium and mixtures thereof.

17. The method of claim 16 wherein the metal contaminant level on the cracking catalyst is maintained within the range of about 600 to about 2300 wppm equivalent nickel by the addition to the cracking system of equilibrium cracking catalyst.

18. The method of claim 17 wherein replacement catalyst is added to the cracking system and wherein the equilibrium cracking catalyst added to the cracking system comprises from about 5 to about 100 wt.% of the total replacement catalyst.

* * * * *